United States Patent [19]

Schlough

[11] Patent Number: 4,463,941

[45] Date of Patent: Aug. 7, 1984

[54] METHOD AND APPARATUS FOR OPENING FOLDED SHEETS

[75] Inventor: James R. Schlough, Easton, Pa.

[73] Assignee: Stobb, Inc., Clinton, N.J.

[21] Appl. No.: 506,853

[22] Filed: Jun. 22, 1983

Related U.S. Application Data

[62] Division of Ser. No. 328,236, Dec. 7, 1981, abandoned.

[51] Int. Cl.[3] ..... B65H 39/02

[52] U.S. Cl. ..... 270/54

[58] Field of Search ..... 270/54–57

[56] References Cited

U.S. PATENT DOCUMENTS

| | | | |
|---|---|---|---|
| 2,268,600 | 1/1942 | Kleineberg | 270/55 X |
| 2,279,269 | 4/1942 | Tornberg | 270/57 |
| 2,626,074 | 1/1953 | Vogt | 216/55 |
| 2,817,513 | 12/1957 | Bell | 270/54 |
| 2,931,646 | 4/1960 | Davis | 270/54 X |
| 3,176,976 | 4/1965 | Hepp | 270/54 |
| 3,658,318 | 4/1972 | Bunting | 270/55 |
| 4,200,275 | 4/1980 | Wangermann | 270/53 |

*Primary Examiner*—E. H. Eickholt

*Attorney, Agent, or Firm*—Arthur J. Hansmann

[57] ABSTRACT

A method and apparatus for opening folded sheets which are moved from a stack and by a gripper member to a location between two belts. The belts direct the folded sheets to a guide which causes the sheet to become unfolded and the guide then directs the sheet onto a gatherer or collector chain. A sheet opener can also be used for directing one flap of the folded sheet to the far side of the chain which is running at an acute angle with respect to the direction of movement of the unfolded sheet as it approaches the chain.

19 Claims, 7 Drawing Figures

METHOD AND APPARATUS FOR OPENING FOLDED SHEETS

This application is a continuation of Ser. No. 328,236 filed Dec. 7, 1981, now abandoned.

This invention relates to a method and apparatus for opening folded sheets, such as sheets which are in a stack and are taken from the stack and are opened and placed on a gatherer.

BACKGROUND OF THE INVENTION

The Graphic Arts industry is already aware of various methods and apparatus for maneuvering sheets from a stack and placing them into a gatherer, so that a book or magazine can be formed by a series of sheets stacked on each other, all in a conventional and already known manner. Taking individual sheets from various stacks of sheets and collecting or gathering the individual sheets together on a gatherer is the commonly known collating activity such as that shown in U.S. Pat. Nos. 2,279,269 and 2,817,513 and 3,176,976 and 4,200,275, for examples. These patents show the collating process whereby various previously folded sheets are nested and gathered together into one unit. However, complicated and slow speed methods and apparatus are utilized in the prior art collating systems, and, in that regard, the present invention improves upon the heretofore known methods and apparatus by providing a high speed method and apparatus which can handle the sheets at a high speed and accurately and continuously collect or collate the sheets from various stacks, all as desired. The prior art commonly requires sheet grippers, of either the mechanical or pneumatic operating type which require extreme precision and complexity of apparatus in order to handle the folded sheet and unfold it and place the sheet on a gathering chain or the like, and the aforesaid patents, along with U.S. Pat. No. 2,626,074, are examples of the complex and highly detailed prior art methods and apparatus heretofore known in the collating function.

Accordingly, the present invention distinguishes over the prior art in that it provides a high speed method and apparatus for collecting or collating folded sheets which are originally available in various stacks of sheets and which can be collected in a single unit or assembly of a sheet from each of the stacks.

Further, the present invention provides a method and apparatus for opening folded sheets and ultimately collating the opened sheets and it does so by moving the sheets in one straightline direction and not requiring that the sheets be moved in various directions or even in any arcuate direction after the sheet has reached a guide which opens the sheet. Further, the guide and all apparatus for opening the sheet are stationary and have no moving parts and only the sheet moves relative to the guide and is thereby opened for placement and positioning on a gathering chain of a conventional nature. Accordingly, the present invention permits a high speed handling of the sheets and it achieves the required continuous operation and accuracy of sheet placement and it accomplishes all of these supreme objectives without requiring any complicated and detailed apparatus.

A further object of this invention is to provide a method and apparatus for collating, or opening folded sheets and collecting them into a unit, wherein already existing delivery cylinders with grippers can be utilized for taking individual sheets from a stack of folded sheets. That is, the already existing delivery drum can be utilized, and the sheet will be taken from the prior art drum and led on through utilization of the method and apparatus of the present invention. Therefore, equipment already in existence need not be discarded and instead can be utilized with the present invention.

DETAILED DESCRIPTION OF THE PREFERRED METHOD AND EMBODIMENT OF THE APPARATUS

Figure 1:
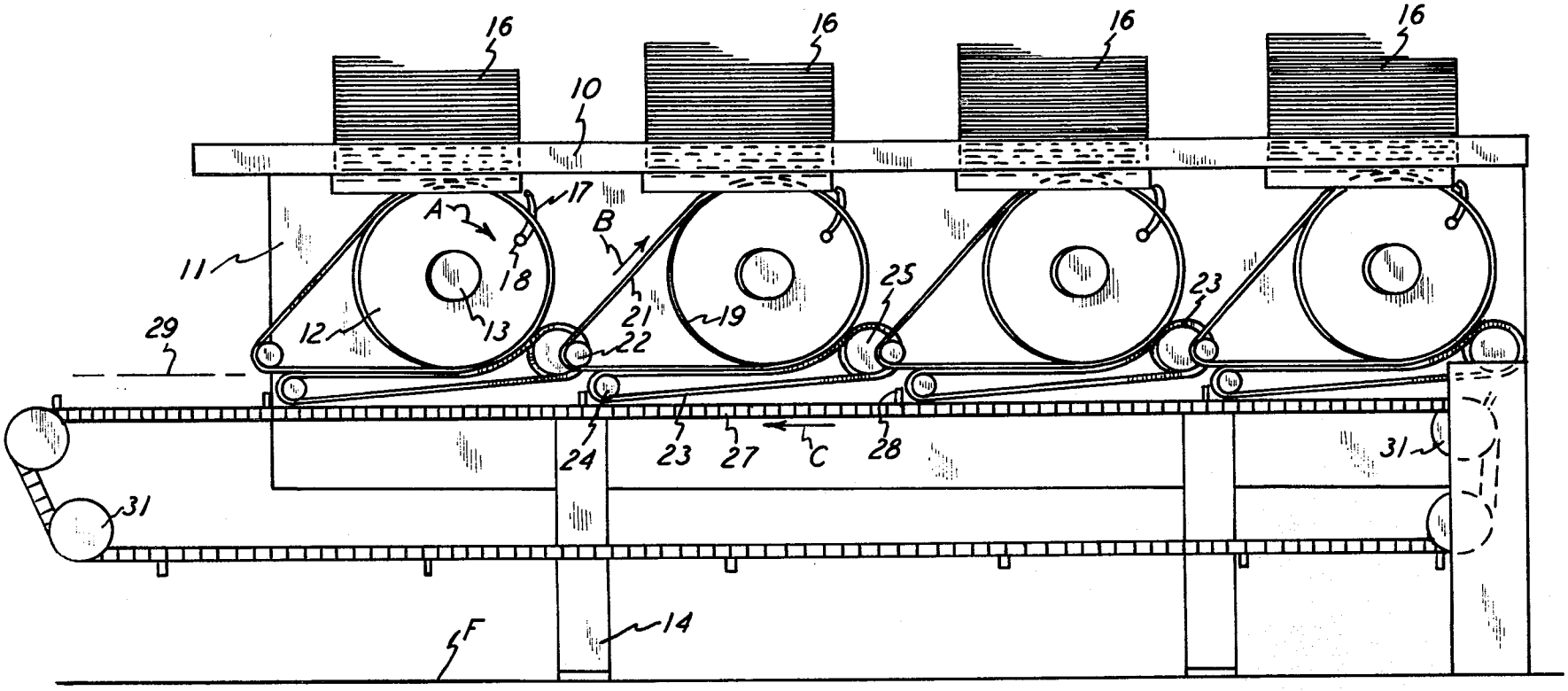
FIG. 1 is a side elevational view of generally conventional apparatus but showing the belt system for this invention.

The following description makes reference to the apparatus shown in the drawings, and, in doing so, the method is also disclosed by reference to that apparatus. Further, anyone skilled in the art is already aware of the general arrangement of the apparatus wherein sheets are taken from various stacks of folded sheets and placed onto a moving collector chain or gatherer, all in the well-known collating process, such as that shown in the patents cited herein. Accordingly, detailed description of that portion of the apparatus is not necessary in the present instance, though FIG. 1 does show a general arrangement of the apparatus, including the particular conveyor or belt arrangement for taking the sheets away from the various stacks and placing them on the conventional collector chain.

The apparatus includes a suitable frame or framing including a horizontally disposed bed piece 10 and side support pieces 11 which rotatably support pick-up drums 12 which are on axles 13. Also, standards or legs 14 are shown resting on a floor line F and extending thereabove to support the frame pieces 10 and 11, as described. Thus, any conventional framework can be utilized for suitably supporting the apparatus and elements to be hereinafter described and for supporting the plurality of stacks 16 which are sheets of folded paper and four such stacks are shown for an example. The individual sheets 17 in each of the stacks 16 is folded, actually slightly off a one-half fold to be more fully described later, and each sheet is in the horizontal position in the stack 16 with the fold thereof to be on the far side, as viewed in FIG. 1, and with the open end of the folded sheet on the near side, as viewed in FIG. 1, and that too will be more apparent on the other sheet of drawings. Each stack 16 is thus conventionally and suitably upwardly supported in the frame 10, and the bottom sheet of each stack 16 is exposed to the pick-up drum or mechanism 12 and is moved from the stack by the drum or mechanism 12 in the direction of the arrow designated A and thus the sheet moves in a clockwise direction from the location of the stack 16 down to the bottom of the drum 12. To accomplish the pick-up, the conventional sheet gripper 17 is shown on each rotating member or drum 12, and the gripper is indicated to be pivotable thereon about the pivot point 18 so that it can open up and receive the lower folded sheet in each stack 16 and then pivot inwardly onto the drum 12 or close and thereby carry the gripped sheet 15 in the direction of the arrow A, as mentioned. The pick-up and gripper are conventional and need not be further described, and any type of usual conventional gripper mechanism can be used, such as those indicated and shown in the aforesaid cited patents.

Each drum 12 has a circular circumference 19 on which a belt 21 is trained, and the belt 21 is also trained on a pulley 22 shown spaced from each drum 12. Thus the belt 21 is endless and extends over a portion of the drum 12 and a portion of the pulley 22, and of course the belt 21 moves in the direction of the arrow designated B and it moves in response to the rotation of the pick-up drum 12. Another belt 23 is disposed adjacent the drum 12 and is trained over a pulley 25 which is in close relationship with or even contact with the drum 12. The belt 23 is also trained around a pulley 24 which is located adjacent the pulley 22, all so that the belts 21 and 23 extend to about the same terminal end, namely, the location of the pulleys 22 and 24.

It will be therefore between and understood that when each gripper 17 picks up a single one of the folded sheets 15, the sheet is then disposed on the outside of the belt 21, relative to the radial direction of the cylindrical drum 12, and the sheet 15 is then carried into the reach of the belt 23 at the location of the pulley 25. That is, the folded sheet 15 is then positioned between the two endless belts 21 and 23, which form a forwarding conveyor and the sheet continues to move toward the belt terminal pulleys 22 and 24 and that basically is in a horizontal direction and to the left, as viewed in FIG. 1.

It will also be understood that the plurality of drums 12, and the location and operation of each of their pick-up or gripper mechanism 17, is all synchronized that they operate in sufficient relationship to one another so that they pick up the sheets 15 from each stack 16 to deposit the sheets on the conventional collector chain or gatherer 27. The gathering conveyor or chain 27 moves in the direction of the arrow designated C, and it is powered under conventional and suitable drive means which are not shown but which are standard, such as that shown and indicated in the aforesaid cited patents. Eventually, as explained in connection with the second sheet of drawings, the individual sheets 15 are deposited onto the moving chain 27, and the sheets 15 are unfolded before being deposited and are deposited one on top of another so that, where there are four original stacks 16 then there will be four sheets stacked on each other to form a signature or unit, as such. Thus the chain 27 has standard pushers 28 which are upstanding on the chain 27, and the individual sheets 15 are dropped onto the chain 27 in front of the pushers 28 which therefore move all of the sheets in the direction of the arrow C, along with that movement of the chain. As will also be seen in connection with the second sheet of drawings, the drums 12 and the belts 21 and 23 are at a slight angle, that is, the belt pulleys 22 and 24 are closer to the near side of viewing in FIG. 1 relative to the actual drum 22, and thus the belts 21 and 22 are at an angle relative to the longitudinal line of the chain 27, and that angle may be approximately 20 or 25 degrees. Therefore, there is a slight perspective showing for the drum 12, its mounting shaft and for the pulleys 22, 24, and 25. Also, it will be seen that the horizontal plane between the belts 21 and 23, and designated 29, extends slightly above the top elevation of the chain 27 which is also shown to be horizontally disposed in its top extent. Therefore, with the sheets 15 between the belts 21 and 23, the sheets 15 can be dropped onto the chain 27 which is at the slightly lower elevation. Further, for purposes of description and clarity in connection with FIG. 1, the paper guide shown and described in connection with drawing sheet two, the guide is not included in FIG. 1 but is fully disclosed in FIG. 2.

FIG. 1 further shows that the gathering conveyor 27 is an endless chain and extends underneath the delivery structures which include the drums 12, and the chain 27 is movably mounted on the sprockets on the like 31. Thus each chain pusher 28 will collect one sheet from each stack 16 to collect a unit of four sheets, in the arrangement shown in FIG. 1, and the chain 27 is continuously moving at a steady speed in the direction of the arrow C to collect the four sheets in the collating process, as mentioned.

Figure 2:
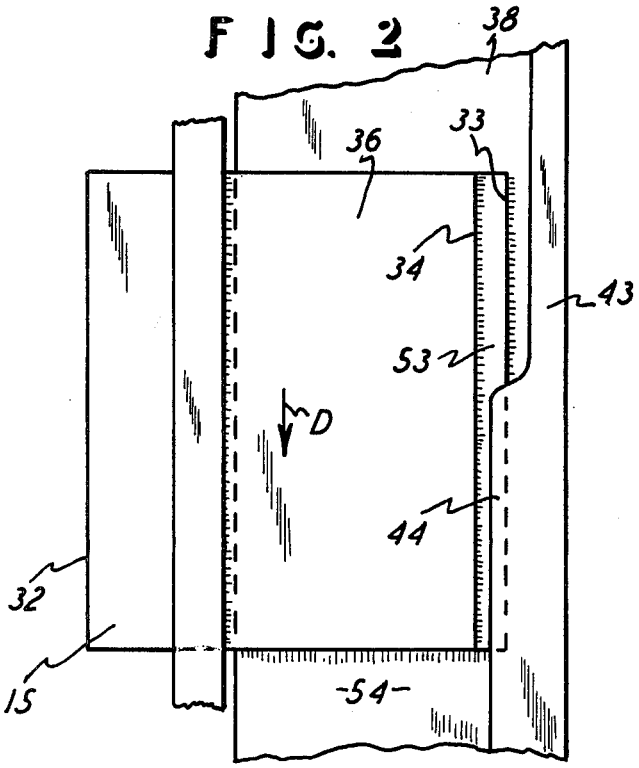
FIG. 2 is a top plan view of a sheet and a fragment of the belt and sheet guide of FIG. 1.
Figure 3:
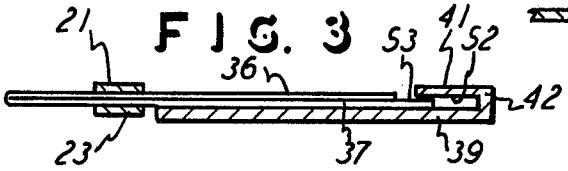
FIG. 3 is an end elevational view of FIG. 2.

FIGS. 2 through 5 show that the folded sheet 15 is engaged by the belts 21 and 23 which are in a face-to-face relationship or aligned with each other and are offset to the side of the sheet 15 adjacent the fold line 32. Also, the folded sheet 15 presents a first free edge 33 and a second free edge 34 which is offset from the edge 33, as clearly shown in FIG. 2. That is, the fold of each sheet 15 is slightly off a one-half fold condition and thus the two free edges 33 and 34 are spaced apart or offset from each other when the folded sheet 15 in its flat position, as seen in FIG. 3. The upper flap 36 of the folded sheet 15 thus terminates in the free edge 34 and is the short flap of the folded sheet 15, and the lower flap 37 is the long flap, and the extent of flap 37 beyond flap 36 is the lap margin of the folded sheet 15. Of course the sheets 15 were in the folded condition in the stacks 16 and they were oriented, as previously mentioned, so that the flaps 36 and 37 have the respective upper and lower positions when the sheet 15 arrives at the horizontal extent 29 between the two tapes 21 and 23, and that is the position from the lowermost point on each drum 12 and leftward to the pulley 24. It is through that horizontal designation as defined by reference 29 that the paper guide 38 is horizontally disposed, and it will be seen that the guide 38 includes a lower flat plate portion 39 and an upper flat plate portion 41 and an interconnecting portion 42. The portions 39 and 41 are horizontal and, as mentioned, they extend generally throughout the length of the planar or horizontal extent of the upper extent of the belt 23 all as mentioned. Therefore, the guide 38 is arranged and located so that when the sheet 15 is picked up between and controlled by the belts 21 and 23, the sheet 15 is also then laid onto the guide portion 39, as shown in FIGS. 2 and 3.

The guide upper portion 41 has a narrow portion 43 and a wider portion 44 which overlaps the sheet lower flap 37, as shown in FIGS. 2 and 3. That is, when the paper or sheet 15 is advancing in the direction of the arrow designated D in FIG. 2, then the sheet free edge 33 passes underneath the guide flat portion 44, but of course the sheet free edge 34 does not pass under the portion 44.

Figure 4:
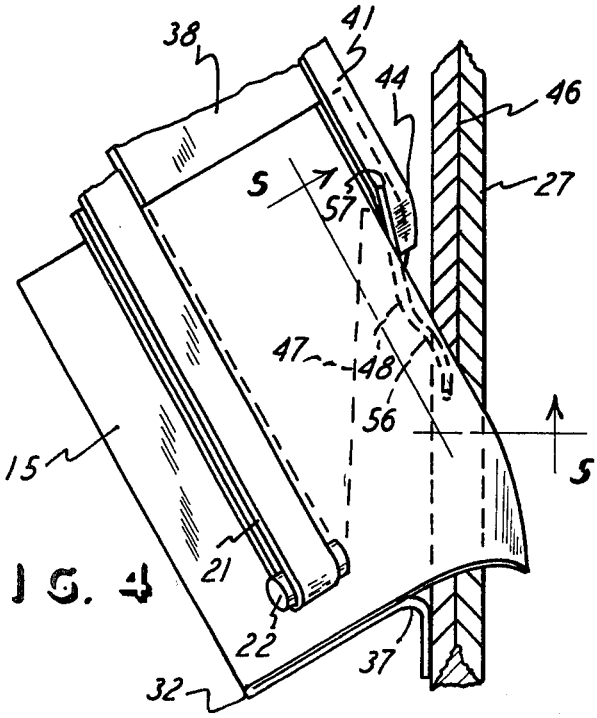
FIG. 4 is a top perspective view of the terminal end of the items shown in FIG. 2, and showing the collector chain.

The guide 38 extends to a location adjacent the gathering conveyor or chain 27, and the guide actually terminates on the near side of the longitudinal axis 46 of the chain 27, and that is the direction or axis of movement of the chain 27, as seen in FIG. 4. The guide 38 has its terminal end 47 shown adjacent the chain 27 and extending underneath the sheet 15 which it is supporting. Also, the belt 21 and its pulley 22 are shown extending to a position adjacent the chain 27 and terminating thereat.

Figure 5:
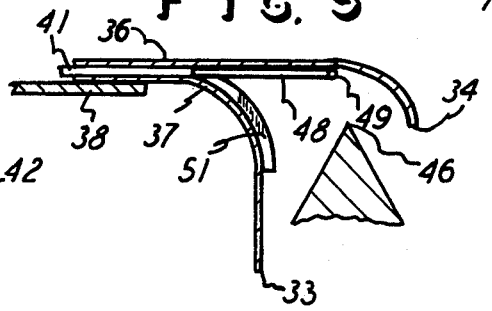
FIG. 5 is a sectional view taken along the line 5—5 of FIG. 4.

The guide portion 44 is shown in FIGS. 4 and 5 to be curved downwardly from its horizontal orientation as shown in FIGS. 2 and 3, and therefore the advancing sheet 15 will have its lower flap 37 directed downwardly to the near side of the chain 27, as seen in FIGS. 4 and 5. Therefore, the folded sheet 15 begins to become unfolded in that the sheet lower flap is deflected downwardly while the sheet upper flap 36 is permitted to go in its original horizontal direction and thus pass over the top of the chain 27 and will then go, by gravity, downwardly to one side of the chain 27 relative to the direction of movement of the chain 27. FIG. 4 also above that the belt 21 and the guide 38 are at an angle relative to the longitudinal axis 46 of the chain 27, as previously mentioned.

Therefore, the guide 38 has engaged the lower flap 37 of the folded sheet 15, that is, it has actually engaged the extended sheet free edge 33, and the edge 33 is then directed downwardly to the near side of the chain 27 as the sheet 15 is unfolded by virtue of its advancing movement of the downward deflection mentioned.

To assist the short or top flap 36 to go over the gatherer 27 and to the far side of its line of direction of movement, a sheet opener 48 is attached to the guide portion 41 and extends horizontally therebeyond, such as shown in FIGS. 4 and 5. The opener 48 terminates in an end 49 which is above the elevation of the top of the chain 27 and which is in the approximate vertical plane of the chain 27. Thus, the sheet flap 36 slides over the opener 48 and continues to move horizontally and to the far side of the chain 27. The sheet of course then reaches a final position where the sheet fold 32 rests on the chain opener apex line 46, and the sheet flaps 36 and 37 are then on opposite sides of the chain 27. Of course the inertia of the moving flap 36 will also cause the flap 36 to be directed to the far side of the chain 27 while the sheet 15 is being moved along by the belts 21 and 23 and while the sheet lower flap 37 is being deflected downwardly, as shown.

The guide portion 44 has its terminal end 51 located on the near side of the chain 27 with respect to the direction of movement of the sheet 15, and the end 51 is shown at an elevation below the elevation of the chain apex 46, all to assure that the sheet flap 37 is deflected downwardly on the near side of the chain 27. Of course the guide 38 has its terminal end 47 spaced from the chain 27 so that the sheet flap 37 can be deflected down into the space between the guide 38 and the chain 37, all as indicated.

In summary, the sheets 15 are initially folded slightly off the one-half fold which means that their free edges 33 and 34 are offset, as shown in FIG. 2. The folded sheets are then positioned in the stacks 16 and are picked up by the pick-up drum 12 and are led to the position between the belts 21 and 23 in the offset manner as also shown in FIG. 2. Next, the longer flap 37 is engaged by the guide portion 44 which causes the sheet to become unfolded while the flap 37 is directed downwardly to one side of the chain 27 and the other flap 36 is directed over to the other side of the chain 27. Finally, the sheet 15 passes beyond the control of the belts 21 and 23 which are moving continuously, and thus there can be a high speed action, compared to the speed of present day equipment, for placing an unfolded sheet onto a gatherer or a collecting chain. In this process and apparatus, the two belts 21 and 23 are forwarding members which continuously move the sheet toward the gatherer, and the sheet edge 33 is moved away from the edge 34 and the opener 48 is inserted between the two sheet flaps 36 and 37, all in the unfolding of the sheet. Also, the guide 38 has a surface 52 which extends parallel to the belts 21 and 23 and which engages the upper surface 53 of the lower flap 37 to therefore deflect and direct the lower flap 37 and its edge 33 in the downward direction mentioned. It will also be seen and understood that the guide 38 has an upper surface 54 on which the sheet 15 initially rests as it is moved along by the belts and until the sheet commences to be unfolded. Of course the opener 48 has its terminal end 56 in the path of movement of the sheet upper flap 36 so that it engages the undersurface of the upper flap to direct the upper flap 36 to the far side of the chain 27, as shown. The opener 48 is attached to the guide 38 at the location 57 in a smooth transition type of attachment, that is, at the same plane and not protruding above the plane of the guide 38, as shown in FIG. 5, so that the sheet flap 36 will slide over the opener 48, and of course the opener projecting end 56 extends at an elevation higher than the elevation of the guide downwardly extending portion 44.

Thus, the guide 38 is an elongated flat element which is mounted on the framing shown and described, in any suitable manner at all just so the guide 38 extends in a position on the horizontal plane 29, as described. Thus, the guide has its one end adjacent the pulley 25, and the other end of the guide extends as shown on sheet 2 of the drawings and as described therein. Thus, the guide 38 is arranged and positioned so that when the belts 21 and 23 engage the sheet 15, the two belts will place the sheet on the guide 38 adjacent the pulley 25.

The relative positions of the guide 38 and the terminal ends of the belts 21 and 23 and the chain 27 are such that the sheet fold 32 will be deposited on the chain apex 46 so that the sheet 15 is draped over the chain in the conventional manner.

Figure 6:
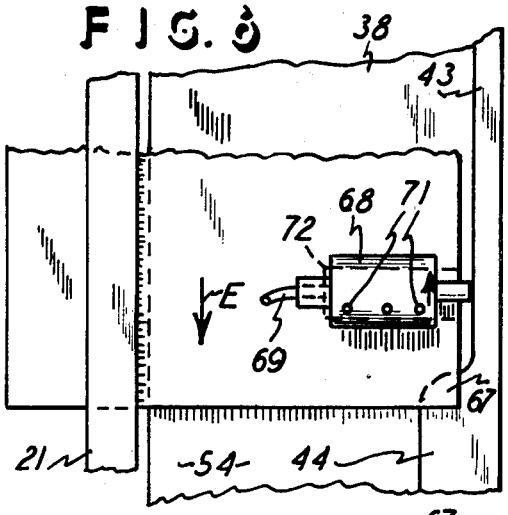
FIGS. 6 and 7 are top plan and end elevational views of another system of this invention.
Figure 7:
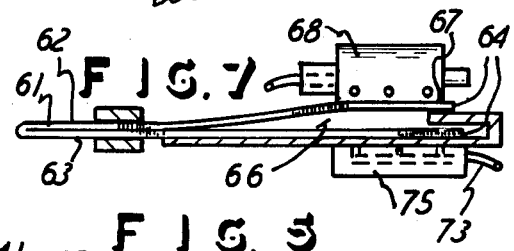

FIGS. 6 and 7 show a different system, including the method, and, in that instance, mechanical means are employed for separating the two sides of one folded sheet, as shown in FIG. 7, and, in that instance, the sheet is designated 61 and is folded in half so that its sides 62 and 63 are of the same length. Accordingly, the sheet edges 64 align with each other when the sheet is in the customary flat position such as when it is in the stack 16.

Therefore, when handling the sheet 61 which is of an even, rather than uneven, fold, as shown in FIGS. 6 and 7, then mechanical means are shown to be employed for separating the two sides 62 and 63 from each other to provide the space 66 therebetween. The mechanical means are located and are effective at a point prior to the location of the guide flat portion 44, relative to the movement of the sheet 61 in the direction of the arrow designated E. Of course the purpose and method is to direct, by lifting, the upper page or sheet 62 away from the lower page or sheet 63 and to place the sheet edge portion 67 on top of the guide flat portion 44, as shown in FIGS. 6 and 7.

To separate the pages 62 and 63, the mechanical means shown is a vacuum system including a rotary wheel 68 disposed essentially in rolling contact with the upper surface of the top sheet 62, and the wheel 68 has a pneumatic or vacuum line 69 attached thereto and it has suction cups or air openings 71 on the surface of the wheel 68 and exposed to the top surface of the upper sheet 62 to raise the upper sheet, in a manner essentially standard or conventional in the art. Thus, the roller 68 would be preferably powered to rotate in the direction of the arrow shown thereon and, it would be in rolling contact with the folded sheet 61.

Also, there could be a pneumatic device, such as another roller 68 or the block 75 disposed beneath the folded sheet 61, and it too could have a vacuum line 73 connected thereto and have means for exposing the suction or vacuum to the lower surface of the lower sheet 63 to hold the lower sheet 63 away from the raised upper sheet 62 and thus on the surface 54 of the guide 38. It will of course be seen and understood that the guide 38 is of the same construction as that shown in the other embodiment, except of course that the guide has air passageways for accommodating the suction member 75 disposed therebelow, in the arrangement shown in FIGS. 6 and 7.

In summary, the system includes the disclosed apparatus and the method, all for separating the sheets of either an uneven folded sheet or signature or an even sheet or signature, as described herein. In either instance, the separated pages of the folded sheet are then directed into the collating or collecting conveyor 27, as shown in FIG. 4, and thus the various supply stacks 16 can have their respective sheets deposited one on top of the other on the collating conveyor 27. The entire system provides for an efficient and continuous and rapid collating, and the sheets move in a non-stop manner when either embodiment is utilized.

What is claimed is:

1. A method for opening folded sheets to be gathered together on a gathering conveyor moving along a pair of movement, each sheet being folded to define two flaps connected along a fold line and folded so as to have the one edge opposite the fold line and of one flap extend beyond the other edge opposite the fold line and of the other flap to form a lap margin, moving the folded sheet toward the gathering conveyor and in a substantially horizontal orientation with said one edge positioned below said other edge, engaging said one edge of the moving folded sheet on a guide curved surface and sliding said one edge under said curved surface while guiding said one edge away from said other edge to thereby unfold said sheet, guiding said one edge of said sheet to one side of the path of movement of the gathering conveyor and positioning said other edge of said sheet to the other side of the path of movement so as to deposit each said sheet with said flaps straddling the gathering conveyor.

2. A method for opening folded sheets to be gathered together on a gathering conveyor moving along a path of movement as claimed in claim 1, including the step of gripping the folded sheet between two belts on the opposite faces of the folded sheet and adjacent only the fold line therein, for moving the folded sheet toward the gathering conveyor.

3. A method for opening folded sheets to be gathered together on a gathering conveyor moving along a path of movement as claimed in claim 1 or 2, including moving the folded sheet on a horizontal plane toward the gathering conveyor in a direction of movement at an acute angle, measured on the horizontal plane, to the path of movement of the gathering conveyor.

4. A method for opening folded sheets to be gathered together on a gathering conveyor moving along a path of movement as claimed in claim 1 or 2, including moving said other edge of the folded sheet onto an opener, and sliding the inside of the folded sheet over the opener in directing the aforesaid two edges to opposite sides of the path of the gathering conveyor.

5. A method for opening folded sheets to be gathered together on a gathering conveyor moving along a path of movement, each sheet being folded to define two flaps connected along a fold line and folded so as to have one edge opposite the fold line and of one flap extend beyond the other edge opposite the fold line and of the other flap to form a lap margin, gripping the sheet with two movable forwarding members on opposite faces of the folded sheet and along a line offset on the folded sheet closer to said fold line than to said edges, moving the gripped folded sheet onto a guide and upwardly support said edges of the guide, moving the gripped folded sheet along the guide and onto guide members having terminal ends directed to opposite sides of the gathering conveyor and having oppositely facing surfaces, respectively engaging said edges of the folded sheet with the oppositely facing surfaces and deflecting said edges away from each other and unfolding the sheet and guide said two edges of the sheet to opposite sides of the gathering conveyor, the movement of the folded sheet toward the gathering conveyor being on a horizontal plane and in a direction of movement at an acute angle to the path of movement of the gathering conveyor, and releasing the then unfolded sheet from the forwarding members and depositing the sheet onto the gathering conveyor.

6. A method for opening folded sheets of two pages to be gathered together on a gathering conveyor moving along a path of movement, each sheet being folded to define two flaps connected along a fold line horizontally oriented in a linear direction and with the folded sheet having folded edges extending opposite the fold line and parallel thereto, moving the folded sheet toward the gathering conveyor and along a horizontal path in the linear direction, separating the two flaps and engaging one of said edges of the moving folded sheet on a guide and guiding said one edge vertically away from the other of said edges of the moving folded sheet to unfold said sheet, engaging said one edge of said sheet with a downwardly facing downwardly curved surface for guiding said one edge of said sheet downwardly to one side of the path of movement of the gathering conveyor, and positioning said other edge of said sheet on the other side of the path of movement of the gathering conveyor, the depositing the unfolded sheet onto the gathering conveyor.

7. A method for opening folded sheets of two pages and to be gathered together on a gathering conveyor moving along a path of movement as claimed in claim 6, including the step of gripping the folded sheet between two belts on the opposite faces of the folded sheet and adjacent only the fold line therein, for moving the folded sheet toward the gathering conveyor.

8. A method for opening folded sheets of two pages and to be gathered together on a gathering conveyor moving along a path of movement as claimed in claim 6 or 7, including the step of moving the folded sheet toward the gathering conveyor on a horizontal plane and in a direction of movement at an acute angle to the path of movement of the gathering conveyor.

9. A method for opening folded sheets of two pages to be gathered together on a gathering conveyor moving along a path of movement as claimed in claim 6 or 7, including the step of moving the other of said edges of said sheet onto an opener, and sliding the inside of the fold of the sheet over the opener in directing the aforesaid two edges to opposite sides of the path of the gathering conveyor.

10. A method for opening folded sheets of two pages to be gathered together on a gathering conveyor moving along a path of movement as claimed in claim 6, including positively holding the folded sheet while moving the folded sheet to the gathering conveyor until the folded sheet is engaged by the downwardly curved surface.

11. Apparatus for opening folded sheets of two flaps and to be gathered together on a gathering conveyor moving along a path of movement parallel to the direction of the sheet edges opposite the fold, comprising a forwarding conveyor for gripping the folded sheet at a location thereon to leave said edges free and for moving the sheet toward the gathering conveyor in a downstream direction, a guide in the path of the moving sheet and arranged to extend over only one of said edges, said guide having a curved portion located thereon downstream relative to the direction of movement of the sheet and said curved portion being curved downwardly relative to the downstream direction of movement of the sheet and being directed and terminating at one side of the path of movement of said gathering conveyor for directing said one edge of the sheet to said one side relative to said gathering conveyor, and said forwarding conveyor being of an extent to terminate adjacent said curved portion of said guide for deposition the sheet onto said gathering conveyor.

12. Apparatus for opening folded sheets of two flaps and to be gathered together on a gathering conveyor moving along a path of movement as claimed in claim 11, wherein said forwarding conveyor includes two belts for gripping the folded sheet therebetween, and said guide includes a surface extending parallel to said belts and supporting said edges of the folded sheet.

13. Apparatus for opening folded sheets of two flaps and to be gathered together on a gathering conveyor moving along a path of movement as claimed in claim 1, wherein said guide is stationary and has a portion with an upwardly facing surface located upstream from said curved portion relative to sheet movement and with said upwardly facing surface extending under both said edges of said sheet for upwardly supporting said edges of the folded sheet on said upwardly facing surface before said sheet reaches said curved portion.

14. Apparatus for opening folded sheets of two flaps and to be gathered together on a gathering conveyor moving along a path of movement as claimed in claim 11, including an opener extending adjacent said curved portion for engaging the folded sheet on the folded interior thereof and thereby direct the folded sheet onto said gathering conveyor.

15. Apparatus for opening folded sheets of two flaps and to be gathered together on a gathering conveyor moving along a path of movement as claimed in claim 14, wherein said opener extends at an elevation higher than that of said curved portion and is smoothly attached to said guide for engaging underneath said other edge of the folded sheet and directing said other edge to the other side relative to said gathering conveyor.

16. Apparatus for opening folded sheets to be gathered together on a gathering conveyor moving along a path of movement and with the sheets being folded to define two flaps connected along a fold line and folded slightly off from a one-half fold and thereby having the edge opposite the fold line extend beyond the other edge opposite the fold line to form a lap margin, comprising a forwarding conveyor for gripping the folded sheet at a location thereon to leave said edges free and for moving the sheet in a downstream direction to said gathering conveyor, a guide in the path of the moving sheet for receiving the sheet thereon and upwardly supporting said sheet and arranged to extend into contact with said lap margin, said guide having one portion disposed in one plane and having a downstream end disposed relative to said one portion in the direction of movement of the sheet on said guide and with said downstream end terminating in an arcuately curved portion curved completely off said one plane and about an axis which is transverse to the downstream direction of the movement of the sheet and terminating at one side of the path of movement of said gathering conveyor for engaging said one edge of the sheet and directing said one edge of the sheet away from said other edge of the sheet and to said one side relative to said gathering conveyor, and said forwarding conveyor being of an extent to terminate adjacent said curved portion of said guide for releasing the sheet and depositing the sheet onto the gathering conveyor.

17. Apparatus for opening folded sheets to be gathered together on a gathering conveyor moving along a path of movement and with the sheets being folded slightly off from a one-half fold and thereby having one edge opposite the fold extend beyond the other edge opposite the fold as claimed in claim 16, wherein said forwarding conveyor includes two belts for gripping the folded sheet therebetween, and said guide includes a surface extending parallel to said belts and receiving the said edges of the folded sheet.

18. Apparatus for opening folded sheets to be gathered together on a gathering conveyor moving along a path of movement and with the sheets being folded slightly off from a one-half fold and thereby having one edge opposite the fold extend beyond the other edge opposite the fold as claimed in claim 16 or 17, wherein the folded sheet has an interior defined by and therebetween the flaps thereof, and including an opener extending adjacent said curved portion and terminating toward the side of said gathering conveyor opposite said one side for engaging the folded sheet on the interior thereof and thereby direct the folded sheet onto said gathering conveyor.

19. Apparatus for opening folded sheets to be gathered together on a gathering conveyor moving along a path of movement and with the sheets being folded slightly off from a one-half fold and thereby having one edge opposite the fold extend beyond the other edge opposite the fold as claimed in claim 16, wherein said guide curved portion extends downwardly relative to said one portion to direct said one edge downwardly, and said opener extends at an elevation higher than that of said guide curved portion and is smoothly attached to said one portion of said guide for engaging underneath said other edge of the folded sheet and directing said other edge to the other side relative to the gathering conveyor.

* * * * *

UNITED STATES PATENT AND TRADEMARK OFFICE

CERTIFICATE OF CORRECTION

PATENT NO. : 4,463,941

DATED : 7 August 1984

INVENTOR(S) : James R. Schlough

It is certified that error appears in the above-identified patent and that said Letters Patent are hereby corrected as shown below:

Column 7, line 34, "pair" should read -- path --

Column 8, line 16, "of" should read -- on --

Column 8, line 49, "the" second occurrence should read -- and --

Column 9, line 31, "tion" should read -- ting --

Column 9, line 41, "claim 1," should read -- claim 11, --

Column 10, line 3, "the" should read -- one --

Column 10, line 56, "16" should read -- 18 --

Signed and Sealed this

*Twelfth* Day of *February 1985*

[SEAL]

*Attest:*

DONALD J. QUIGG

*Attesting Officer* *Acting Commissioner of Patents and Trademarks*